US009819122B1

(12) United States Patent
Lewallen

(10) Patent No.: US 9,819,122 B1
(45) Date of Patent: Nov. 14, 2017

(54) APPAREL COMPUTE DEVICE CONNECTION

(71) Applicant: Intel Corporation, Santa Clara, CA (US)

(72) Inventor: Glen Eric Lewallen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/197,322

(22) Filed: Jun. 29, 2016

(51) Int. Cl.
*H01R 13/62* (2006.01)
*A41D 1/00* (2006.01)

(52) U.S. Cl.
CPC ..... *H01R 13/6205* (2013.01); *A41D 1/005* (2013.01)

(58) Field of Classification Search
CPC ..... H01R 13/625
USPC ..... 439/37
See application file for complete search history.

(56) References Cited

U.S. PATENT DOCUMENTS 4,025,964 A * 5/1977 Owens ..... A61M 39/0247 128/899
4,112,941 A * 9/1978 Larimore ..... A61B 5/0416 439/153
4,453,294 A * 6/1984 Morita ..... E05C 19/16 24/303
5,004,425 A * 4/1991 Hee ..... A41D 13/008 361/220
5,018,044 A * 5/1991 Weiss ..... A61N 1/14 361/212
5,645,063 A * 7/1997 Straka, Jr. ..... A61B 5/04085 600/391
5,677,822 A * 10/1997 Cohen ..... H05F 3/02 361/220
5,980,266 A * 11/1999 Hsu ..... H01R 13/2421 439/37
6,030,229 A * 2/2000 Tsutsui ..... H01R 13/6205 336/90
6,129,559 A * 10/2000 Hirata ..... H01L 24/72 174/253
6,272,694 B1 * 8/2001 Weaver ..... A41D 13/008 2/456
6,319,015 B1 * 11/2001 Faunce ..... H01R 11/22 24/662
7,270,580 B2 * 9/2007 Bradley ..... A61B 5/04087 439/729
7,462,035 B2 * 12/2008 Lee ..... H01R 12/592 439/121

(Continued)

OTHER PUBLICATIONS

Crane, Lee, "Sensoria Fitness Smart Sock Review", Digital Trends, [Online]. Retrieved from the Internet: <URL: http://www.digitaltrends.com/fitness-apparel-reviews/sensoria-fitness-smart-sock-review/#18>, (Oct. 14, 2015), 19 pgs.

(Continued)

*Primary Examiner* — Alexander Gilman
(74) *Attorney, Agent, or Firm* — Schwegman Lundberg & Woessner, P.A.

(57) ABSTRACT

System and techniques for an apparel compute device connection are described herein. A base for a removable apparel compute device is bonded to a garment. The base includes connector portions to interface between the apparel compute device and traces within the garment electrically. The apparel compute device is secured to the base via a magnet and oriented via a physical arrangement of the connector portions.

15 Claims, 6 Drawing Sheets

(56) References Cited

U.S. PATENT DOCUMENTS 7,559,768 B2 * 7/2009 Marmaropoulos .. G09B 23/183 2/69
7,609,503 B2 * 10/2009 Hee ..... A61N 1/14 361/212
8,814,574 B2 * 8/2014 Selby ..... H01R 4/4854 439/346
8,948,885 B2 * 2/2015 Russell ..... A61B 5/0464 600/391
9,043,004 B2 * 5/2015 Casillas ..... G01L 1/205 700/91
9,055,879 B2 * 6/2015 Selby ..... H01R 13/11
9,107,806 B2 * 8/2015 Hafezi ..... A61J 3/071
9,439,566 B2 * 9/2016 Arne ..... A61B 5/0022
9,510,649 B1 * 12/2016 Liu ..... A44B 17/0064
2006/0252284 A1 * 11/2006 Marmaropoulos H01R 13/6205 439/37
2007/0038057 A1 * 2/2007 Nam ..... A61B 5/6805 600/388
2007/0130676 A1 * 6/2007 Von Blucher ..... A41D 1/002 2/456
2007/0293750 A1 * 12/2007 Kuo ..... A41D 13/1281 600/388
2007/0299325 A1 * 12/2007 Farrell ..... A61B 5/0002 600/301
2008/0023508 A1 * 1/2008 Harchol ..... A45F 5/02 224/183
2008/0091097 A1 * 4/2008 Linti ..... A41D 13/1281 600/389
2009/0049871 A1 * 2/2009 Klett ..... A41D 13/005 66/202
2009/0053950 A1 * 2/2009 Surve ..... C23C 4/04 442/181
2009/0095094 A1 * 4/2009 Helmer ..... A61B 5/103 73/865.4
2013/0131484 A1 * 5/2013 Pernu ..... A61B 5/0245 600/388
2014/0296651 A1 * 10/2014 Stone ..... A61B 5/6804 600/301
2015/0349457 A1 * 12/2015 Shariff ..... H01R 24/20 439/37

OTHER PUBLICATIONS

Mitroff, Sarah, "Lump Lift review: A posture tracker that puts design over details", [Online]. Retrieved from the Internet: <URL: https://www.cnet.com/products/lumo-lift/review/>, (Aug. 28, 2014), 11 pgs.

* cited by examiner

APPAREL COMPUTE DEVICE CONNECTION

TECHNICAL FIELD

Embodiments described herein generally relate to smart fabrics and more specifically to an apparel compute device connection.

BACKGROUND

The use of low power wearable sensors (e.g., apparel compute devices) has generated great interest in smart garments for sport and fitness that enable real-time processing of biometric data such as heart rate, respiration rate, body temperature, and motion that may be correlated to provide an indicator of an athlete's performance. Typically, these apparel compute devices include a processing component (e.g., microprocessor, communications, storage, sensor, power, etc.), and a clothing integration component (e.g., isolated conductive features integrated into a garment, such as wires, intra garment communication, etc.).

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

Generally, current arrangements for apparel compute devices include integrating everything into a garment or integrating sensors directly into the garment with conductive traces leading to a removable computing device or hub. A removable hub may allow for ease in charging a battery, for example, as well as reducing manufacturing costs by, for example, not having to guard against a washing environment (e.g., the hub is removed prior to washing the garment). Hub connections in removable arrangements are typically achieved via two or more conductive snap connectors or a pocket sewn into the garment and a wired connection.

As wearable computing devices become smaller and more tightly integrated with garments, there is a need for an attachment method that holds the compute device securely without using connecting snaps prevalent in the industry because snaps tend to be large with respective to fabric surface area as well as "high" or "tall" holding the compute device away from the fabric surface. These problems with current fastening devices may be addressed via a magnetic coupling with a physical arrangement to enforce an orientation of the apparel compute device and the garment. Thus, the special interference of snaps is avoided while still maintaining the detachable nature of the apparel compute device as well as enforcing positional arrangements to improve performance of the apparel compute device when attached to the garment.

Figure 1A:
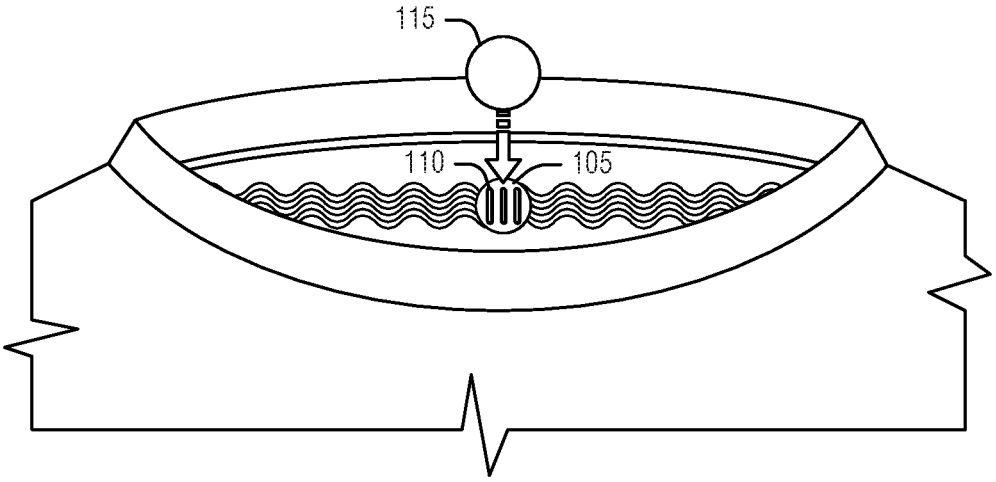
FIGS. 1A and 1B illustrate use of the apparel compute device connection with a shirt, according to an embodiment.
Figure 1B:
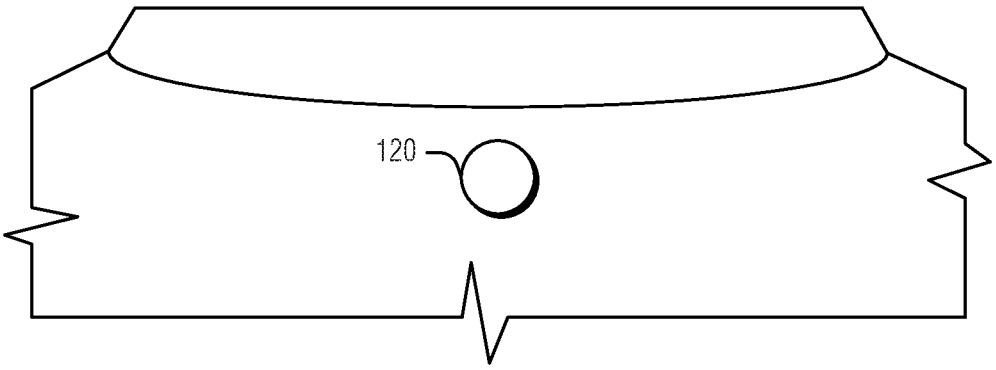

FIGS. 1A and 1B illustrate use of the apparel compute device connection with a shirt, according to an embodiment. FIG. 1A illustrates a front view of a shirt and FIG. 1B illustrates the same shirt from the rear. The connector seat 105 of the base is bonded to the shirt. The base also includes a connector extending through the connector seat. An exterior portion 110 of the base connector provides an electrical interface to a corresponding exterior portion on the apparel compute device 115 when the apparel compute device is seated. The apparel compute device 115 includes a magnetic layer (obscured) to hold it in place. The magnetic layer is a magnet or responsive to a magnetic field (e.g., ferrous metals) to hold the apparel compute device 115 in place. In an example, the cap 120 contains a magnet or magnetic layer to provide a magnetic field, or respond to a magnetic field generated by the magnetic layer, to hold the apparel compute device 115 in place. In an example, the cap 120 is removable. In an example, the cap 120 is not removable (e.g., is bonded to the garment).

The exterior portion 110 of the base connector and the exterior portion of the apparel compute device connector enforce an arrangement of the apparel compute device 115 with respect to the garment. One or both of the exterior portions include an outward extension. In an example, one exterior portion includes corresponding depressions to the outward extension of the mating pair such that they "plug" into each other. The extent of this pairing, however, may not provide sufficient friction holding between the pieces in order to, for example, minimize the profile of the apparel compute device 115 when seated. In an example, both of the exterior portions include outward extensions that interlock (e.g., fit side-by-side). In any case, the arrangement of the portions is such that an orientation of the apparel compute device 115 with respect to the connector seat 105 is enforced when seated.

An interior portion of the apparel compute device connector (not shown) is electrically connected to the exterior portion and to a computer contained in a housing of the apparel compute device 115. Thus, when seated, the computer is electrically connected to at least one element integrated in the garment via the exterior portions and the interior portion of the base (e.g., node seat).

Thus, in an example, the illustrated attachment device may be arranged with three main components, a small, encapsulated computing node (e.g., apparel compute device 115), a node seat (e.g., the connector seat 105), and a magnetized cap (e.g., cap 120). The node 115 houses the processor and electronics, a battery, a thin metal plate, and physical connectors that attach to the garment sensor system. The node seat 105 provides a stable base for connecting the node 115 to the garment. The seat 105 is permanently bonded to the garment and enables electrical contact with the garment's sensing system. The magnetic cap 120 has a strong internal magnet that attracts the node's metal plate through the seat 105 and garment fabric, thereby holding the node 115 securely in place. The magnetized cap 120 is permanently bonded to the outside of the garment.

The magnetic connection enables a apparel compute device 115 to be designed with a much lower profile than those with snap-attachments, further enabling it to be worn comfortably inside a garment. The magnetic attachment also enables the compute device 115 to be attached without the use of an internal pocket, which has the advantage of allowing the compute device 115 sensors to reside close to the skin without a fabric barrier. The compute device 115 is easy to tend to by the user and may be attached without visual inspection by feeling the connection "snap" into the proper position when the connector pins are physically engaged.

The small, permanently magnetized cap 120 is washable. The cap 120 may be designed to reflect the manufacturer's brand including logos, colors, or specific shapes or materials. Thus, the garment maintains a clean aesthetic appearance whether or not the compute device 115 is attached as the connectors may remain hidden inside the garment.

Figure 2:
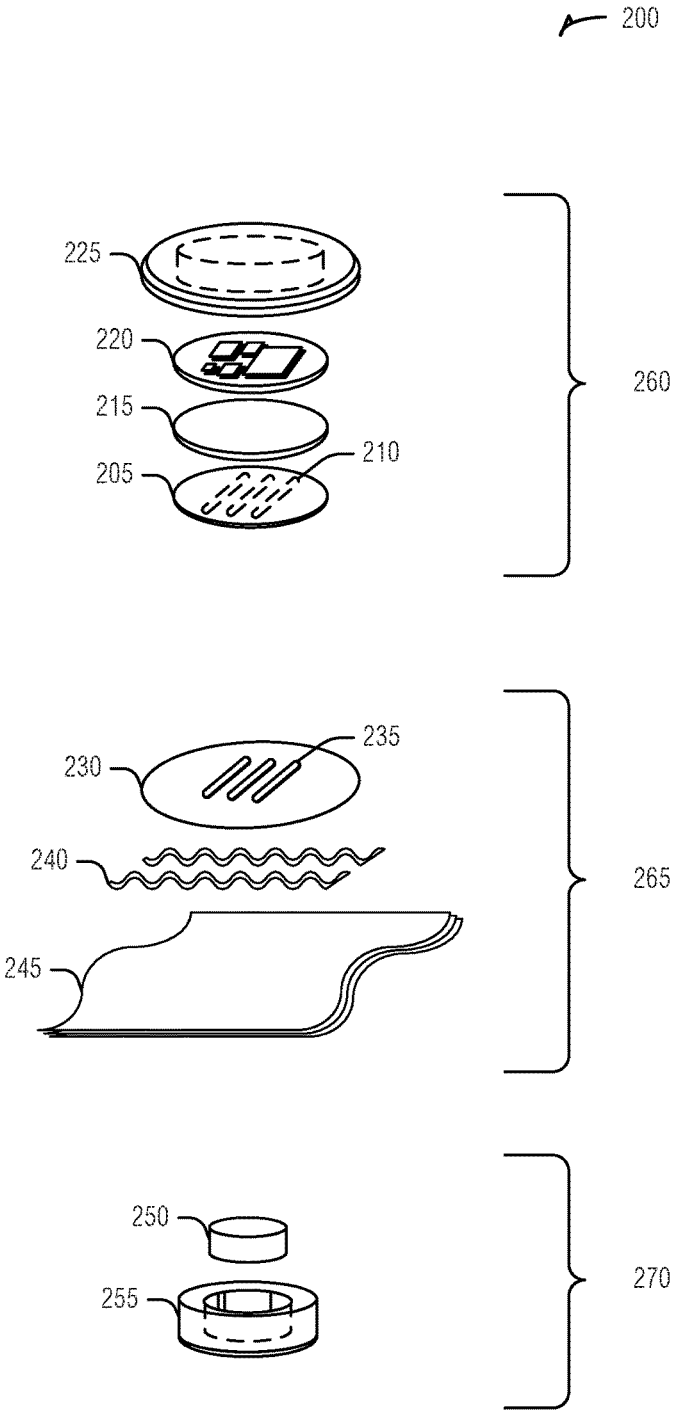
FIG. 2 illustrates a block diagram of an exploded assembly of an apparel compute device connection, according to an embodiment.

FIG. 2 illustrates a block diagram of an exploded assembly of an apparel compute device connection, according to an embodiment. The elements 260 comprise an example of the apparel compute device 115, the elements 265 comprise an example of the base 105, garment surface 245, and traces (e.g., wires) 240 integrated into the garment surface 245, and the elements 270 comprise an example of the cap 120.

The apparel compute device 260 (e.g., node) includes a housing 225, a computer 220 (e.g., electronics), a battery 215, and a magnetic layer 205. The magnetic layer 205 includes one or more apertures 210 for conductive material to extend through the metal surface 205. The conductor includes an interior portion (e.g., interior with respect to housing 225) that has an interface (e.g., bus, wire, plug, etc.) to the computer 220 contained in the housing 225. The conductor also includes an exterior portion that includes a conductive structure extending perpendicular to the magnetic layer 205 and arranged to orient the magnetic layer 205 (and also the housing 225 if it is immovably bonded to the magnetic layer 205) when connected to the base 230. The orientation arranged may be achieved with a single conductive structure based on its shape. That is, if the shape is asymmetrical in one direction, it will not be reversible in that direction. In an example, one or more additional conductive structures (e.g., as illustrated three conductive structures are used). These additional structures may provide additional functionality (e.g., signal, power, clock, etc.) and may also facilitate orientation of the magnetic layer 205 with respect to the base 230 when seated.

In an example, the conductive structures of the connector have at least one of a width or length greater than a height. Here, length and width are measured in the plane of the magnetic layer 205 and height is measured perpendicular to that surface (e.g., the height is the degree to which the exterior portion extends inwards or outwards from the magnetic layer 205). This arrangement provides for a low profile interface while increasing conductive surface area contact with an exterior portion 235 of the base connector. In an example, the exterior portion of the conductor extends outwards from the magnetic layer 205 (e.g., it is a post or tine). In an example, the exterior portion extends inwards from the magnetic layer 205 (e.g., it is a depression or socket). In an example, the magnetic layer 205 or the housing 225 includes an edge (e.g., a lip, ridge, groove, etc.) arranged to position the magnetic layer 205 with regard to the seat 230. For example, given exterior portions for the apparel compute device 260 and the base connector 235 that both extend outwards, a rotational orientation may be enforced by the exterior portions alone (e.g., the straight line-like exterior portions must align for the seating to take place, but they may slip along that rotational orientation. The edge of the magnetic layer 205, in this example, will operate to prevent such a slip.

The connector seat 230 is arranged to accept the conductor (e.g., exterior portion) from the apparel compute device 260 via a connector extending through the connector seat 230. In an example, the connector seat 230 is not magnetic or responsive to a magnetic field. For example, the conductor is not conductive, a ferrous metal, or a magnet. In an example, the connector seat 230 is bonded to the garment 245. Example bonding may include being sewn, glued, fused, welded, or otherwise paired to the garment 245 in a substantially permanent manner (e.g., generally understood to not be detachable during normal use).

The connector includes an interior portion that has an interface to conductive lines 240 incorporated into the garment 245. The connector also includes an exterior portion 235 that includes a conductive structure extending perpendicular to the connector seat 230. In an example, the exterior portion 235 extends outwards from an exterior surface of the connector seat 230 (e.g., outward with respect to fabric 245). In an example, the exterior portion 235 extends inwards from an exterior surface of the connector seat 230, forming a depression in the surface of connector seat 230.

The cap 270 includes a housing 255 and a magnet 250 held by the housing 255. In an example, the housing 255 is bonded to the garment 245 perpendicular to the connector seat 230 and on a different surface that that of the connector seat 230. This is the arrangement illustrated in FIG. 2, where the cap 270 is behind the seat 230 on the other side of the garment 245. In an example, the housing 255 includes a removable cap allowing access to, and thus removal of, the magnet 250.

Figure 3A:
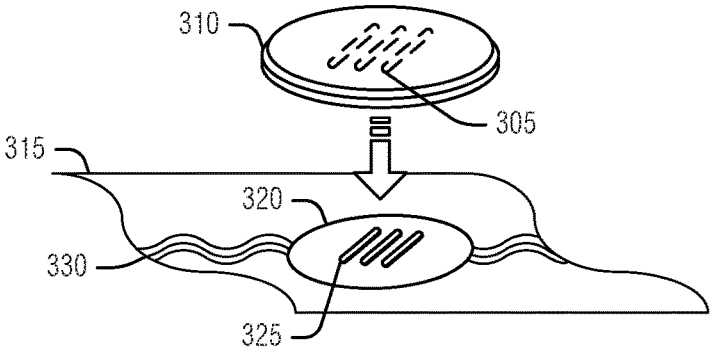
FIGS. 3A and 3B illustrate an assembly of the apparel compute device connection with a shirt, according to an embodiment.
Figure 3B:
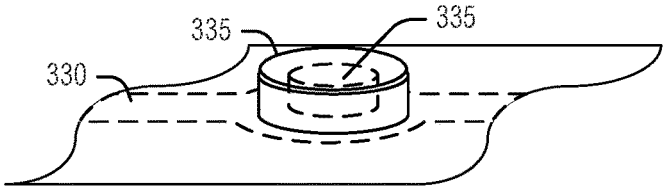

FIGS. 3A and 3B illustrate an assembly of the apparel compute device connection with a shirt, according to an embodiment. FIG. 3A illustrates one side of a fabric surface of the garment 315 while FIG. 3B illustrates the other side of the fabric surface. The assembled apparel compute device 310 includes the exterior portion 305 of its conductor that mates with the exterior portion 325 of the base connector extending through the connector seat 320. Again, the interior portion of the base connector interfaces with wiring 330 embedded in the garment 315.

The cap housing 335 is bonded to the garment 315 behind the seat 320 (illustrated here via the wires 330) and holds the magnet 335. The interaction between the magnet 335 and the magnetic layer of the apparel compute device 310 provides the force to hold the apparel compute device 310 in place while minimizing the profile (e.g., height) of the apparel compute device 310.

Figure 4A:
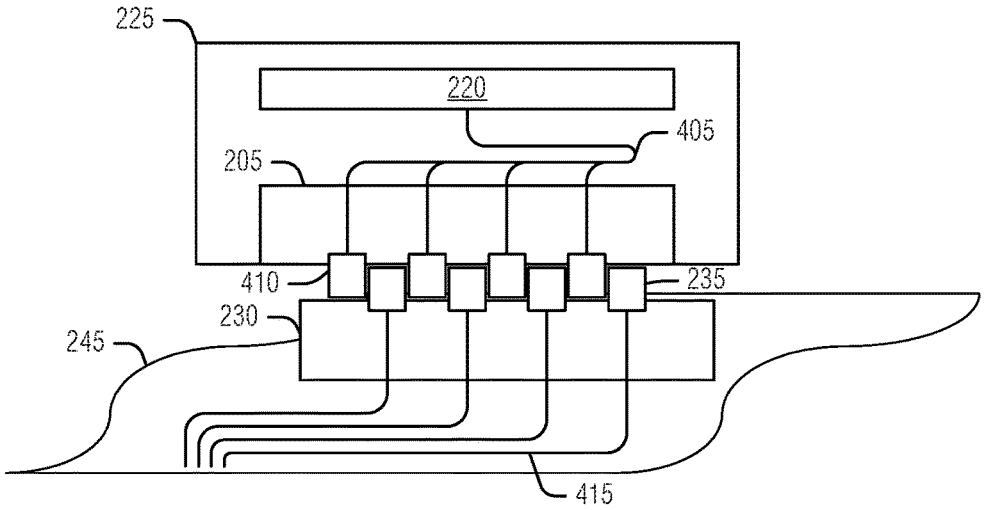
FIGS. 4A and 4B illustrate seating, according to an embodiment.
Figure 4B:
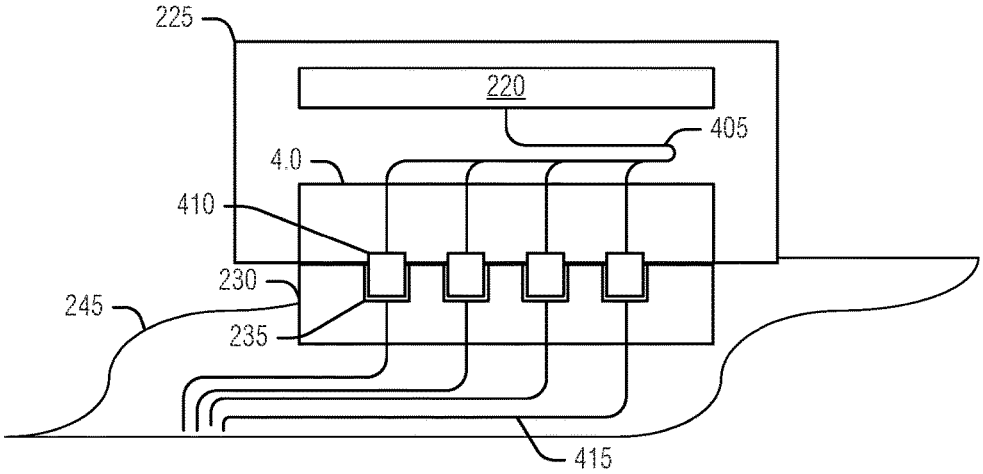

FIGS. 4A and 4B illustrate seating, according to an embodiment.

FIG. 4A illustrates a seating in which both the apparel compute device conductor exterior portion 410 and the base connector exterior portion 235 extend outward from their respective magnetic layer 205 and seat 230. As shown, such a seating provides an electrical connection from the base connector interior portion 415 to the computer 220 via the base connector exterior portion 235, the conductor exterior portion 410, and the conductor interior portion 405. FIG. 4B illustrates the same concept as FIG. 4A except that, in this case, the base connector exterior portion extends inwards from the seat 230 rather than outwards. This arrangement may have an additional benefit of omitting raised connector ends that may discomfort a user when worn without the apparel compute device 225 being seated.

Figure 5:
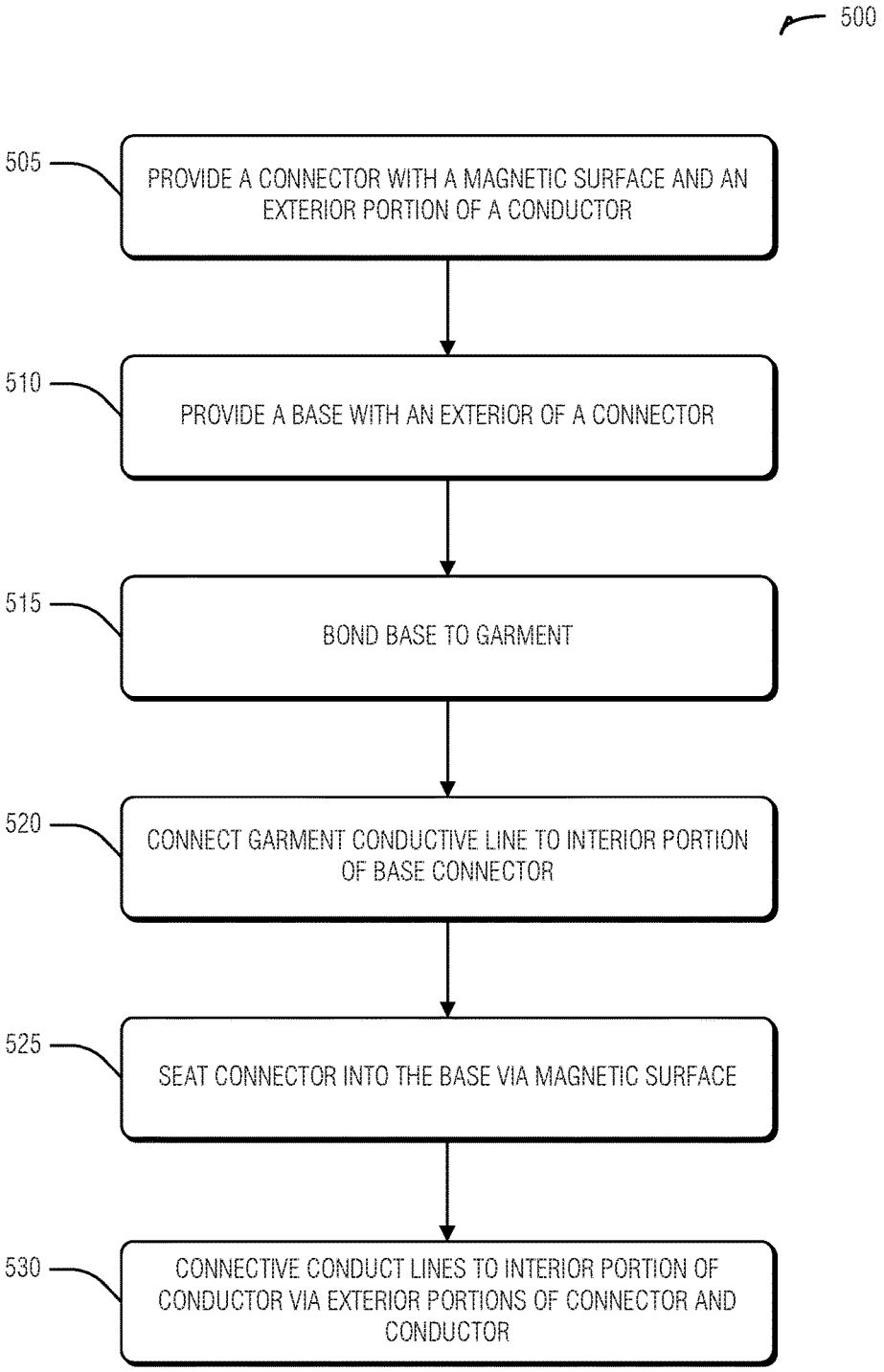
FIG. 5 illustrates an example of a method to implement an apparel compute device connection, according to an embodiment.

FIG. 5 illustrates an example of a method 500 to implement an apparel compute device connection, according to an embodiment.

At operation 505, a connector with a magnetic layer and an exterior portion of a conductor is provided.

At operation 510, a base with exterior of a connector is provided. The combination of the exterior of the connector and the exterior of the conductor enforcing an orientation constraint between the base and an apparel compute device when seated in the base.

At operation 515, the base is bonded to a fabric surface (e.g., of a garment).

At operation 520, conductive lines (e.g., traces) of the garment (e.g., or bag, tent, etc.) are connected to the interior portion of the base connector.

At operation 525, the connector for the apparel compute device may be seated into the base via the magnetic layer, the connector exterior portion, and the base exterior portion. In an example, seating the connector includes inserting the connector exterior portion into the base exterior portion to complete a circuit. In an example, seating the connector includes inserting the base exterior portion into the connector exterior portion to complete a circuit. In an example, where both the connector exterior portion and the base exterior portion respectively extend outwards from the magnetic layer and from the connector seat, seating the connector includes meshing the connector exterior portion and the base exterior portion to complete a circuit.

At operation 530, the conductive lines of the computer in the apparel compute device are connected to the conductive lines of the garment via the connector conductor and the base connector.

In an example, the method 500 may be extended by providing a housing bonded to the garment perpendicular to the connector seat and on a different surface of a fabric to which the connector seat is bonded and providing a magnet held by the housing. In an example, the housing includes a removable cap, the removable cap, when removed, permitting removal of the magnet.

Figure 6:
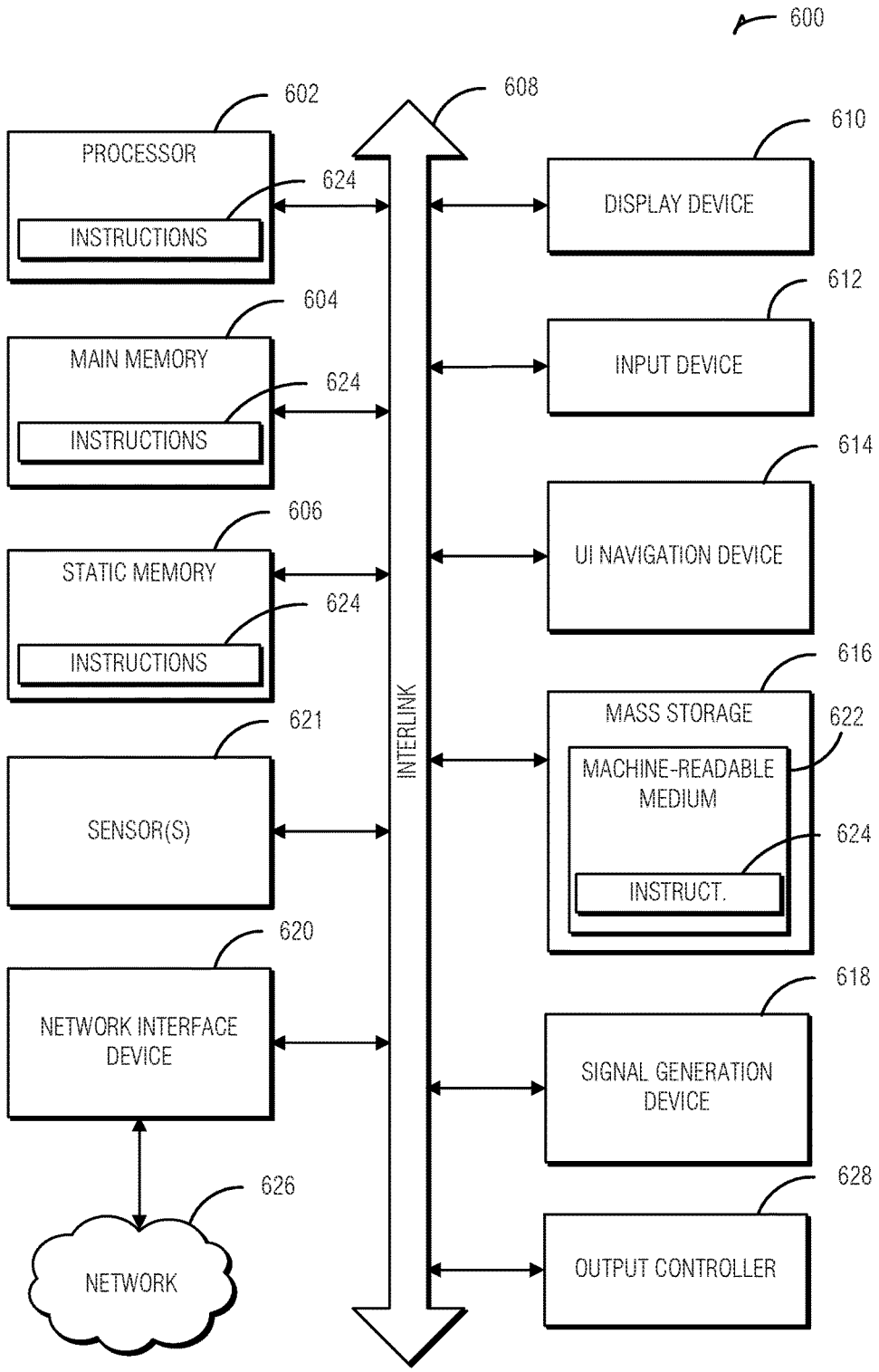
FIG. 6 is a block diagram illustrating an example of a machine upon which one or more embodiments may be implemented.

FIG. 6 illustrates a block diagram of an example machine 600 upon which any one or more of the techniques (e.g., methodologies) discussed herein may perform. In alternative embodiments, the machine 600 may operate as a standalone device or may be connected (e.g., networked) to other machines. In a networked deployment, the machine 600 may operate in the capacity of a server machine, a client machine, or both in server-client network environments. In an example, the machine 600 may act as a peer machine in peer-to-peer (P2P) (or other distributed) network environment. The machine 600 may be any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate by, logic or a number of components, or mechanisms. Circuitry is a collection of circuits implemented in tangible entities that include hardware (e.g., simple circuits, gates, logic, etc.). Circuitry membership may be flexible over time and underlying hardware variability. Circuitries include members that can, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a computer readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, the computer readable medium is communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time.

Machine (e.g., computer system) 600 may include a hardware processor 602 (e.g., a central processing unit (CPU), a graphics processing unit (GPU), a hardware processor core, or any combination thereof), a main memory 604 and a static memory 606, some or all of which may communicate with each other via an interlink (e.g., bus) 608. The machine 600 may further include a display unit 610, an alphanumeric input device 612 (e.g., a keyboard), and a user interface (UI) navigation device 614 (e.g., a mouse). In an example, the display unit 610, input device 612 and UI navigation device 614 may be a touch screen display. The machine 600 may additionally include a storage device (e.g., drive unit) 616, a signal generation device 618 (e.g., a speaker), a network interface device 620, and one or more sensors 621, such as a global positioning system (GPS) sensor, compass, accelerometer, or other sensor. The machine 600 may include an output controller 628, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 616 may include a machine readable medium 622 on which is stored one or more sets of data structures or instructions 624 (e.g., software) embodying or utilized by any one or more of the techniques or functions described herein. The instructions 624 may also reside, completely or at least partially, within the main memory 604, within static memory 606, or within the hardware processor 602 during execution thereof by the machine 600. In an example, one or any combination of the hardware processor 602, the main memory 604, the static memory 606, or the storage device 616 may constitute machine readable media.

While the machine readable medium 622 is illustrated as a single medium, the term "machine readable medium" may include a single medium or multiple media (e.g., a centralized or distributed database, and/or associated caches and servers) configured to store the one or more instructions 624.

The term "machine readable medium" may include any medium that is capable of storing, encoding, or carrying instructions for execution by the machine 600 and that cause the machine 600 to perform any one or more of the techniques of the present disclosure, or that is capable of storing, encoding or carrying data structures used by or associated with such instructions. Non-limiting machine readable medium examples may include solid-state memories, and optical and magnetic media. In an example, a massed machine readable medium comprises a machine readable medium with a plurality of particles having invariant (e.g., rest) mass. Accordingly, massed machine-readable media are not transitory propagating signals. Specific examples of massed machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 624 may further be transmitted or received over a communications network 626 using a transmission medium via the network interface device 620 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 620 may include one or more physical jacks (e.g., Ethernet, coaxial, or phone jacks) or one or more antennas to connect to the communications network 626. In an example, the network interface device 620 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 600, and includes digital or analog communications signals or other intangible medium to facilitate communication of such software.

ADDITIONAL NOTES & EXAMPLES

Example 1 is a connector for an apparel compute device, the connector comprising: a magnetic layer; a conductor extending though the magnetic layer, the conductor including: an interior portion, the interior portion including an interface to a computer contained in a housing secured to the magnetic layer; and an exterior portion, the exterior portion of the conductor including a conductive structure extending perpendicular to the magnetic layer, the conductive structure arranged to orient the magnetic layer when connected to a base.

In Example 2, the subject matter of Example 1 optionally includes wherein the exterior portion includes one or more additional conductive structures.

In Example 3, the subject matter of any one or more of Examples 1-2 optionally include wherein the conductive structure has at least one of a width or length greater than a height, the height being the perpendicular distance between the magnetic layer and the termination of the conductive structure.

In Example 4, the subject matter of any one or more of Examples 1-3 optionally include wherein magnetic layer includes an exterior edge that is arranged to position the magnetic layer in alignment with a portion of the base when seated in the base.

In Example 5, the subject matter of any one or more of Examples 1-4 optionally include wherein the exterior portion extends outwards from an exterior surface of the magnetic layer.

In Example 6, the subject matter of any one or more of Examples 1-5 optionally include wherein the exterior portion extends inwards from an exterior surface of the magnetic layer.

Example 7 is a base for an apparel compute device, the base comprising: a connector seat arranged to accept a conductor for the apparel compute device; and a connector extending through the connector seat, the connector including: an interior portion, the interior portion including an interface to conductive lines incorporated into a garment; and an exterior portion, the exterior portion of the conductor including a conductive structure extending perpendicular to the connector seat.

In Example 8, the subject matter of Example 7 optionally includes wherein the exterior portion extends outwards from an exterior surface of the connector seat.

In Example 9, the subject matter of any one or more of Examples 7-8 optionally include wherein the exterior portion extends inwards from an exterior surface of the connector seat.

In Example 10, the subject matter of any one or more of Examples 7-9 optionally include wherein the connector seat is not magnetic.

In Example 11, the subject matter of any one or more of Examples 7-10 optionally include wherein the connector seat is bonded to the garment.

In Example 12, the subject matter of Example 11 optionally includes a housing bonded to the garment perpendicular to the connector seat and on a different surface of a fabric to which the connector seat is bonded; and a magnet held by the housing.

In Example 13, the subject matter of Example 12 optionally includes wherein the housing includes a removable cap, the removable cap, when removed, permitting removal of the magnet.

Example 14 is a method for an apparel compute device, the method comprising: providing a connector comprising: a magnetic layer; a conductor extending though the magnetic layer, the conductor including: a connector interior portion, the connector interior portion including an interface to a computer contained in a housing secured to the magnetic layer; and a connector exterior portion, the connector exterior portion of the conductor including a conductive structure extending perpendicular to the magnetic layer, the conductive structure arranged to orient the magnetic layer when connected to a base; providing a base comprising: a connector seat arranged to accept a connector for an apparel compute device; and a base connector extending through the connector seat, the base connector including: a base interior portion, the base interior portion including an interface to conductive lines incorporated into a garment; and a base exterior portion, the base exterior portion of the conductor including a conductive structure extending perpendicular to the connector seat; bonding the base to a first surface of a garment; connecting conductive lines of the garment to the base interior portion; seating the connector into the base via the magnetic layer, the connector exterior portion, and the base exterior portion; and connecting the conductive lines to the computer via the connector conductor and the base connector.

In Example 15, the subject matter of Example 14 optionally includes providing a housing bonded to the garment perpendicular to the connector seat and on a different surface of a fabric to which the connector seat is bonded; and providing a magnet held by the housing.

In Example 16, the subject matter of Example 15 optionally includes wherein the housing includes a removable cap, the removable cap, when removed, permitting removal of the magnet.

In Example 17, the subject matter of any one or more of Examples 14-16 optionally include wherein seating the connector includes inserting the connector exterior portion into the base exterior portion to complete a circuit.

In Example 18, the subject matter of any one or more of Examples 14-17 optionally include wherein seating the connector includes inserting the base exterior portion into the connector exterior portion to complete a circuit.

In Example 19, the subject matter of any one or more of Examples 14-18 optionally include wherein the connector exterior portion and the base exterior portion respectively extend outwards from the magnetic layer and from the connector seat, and wherein from seating the connector includes meshing the connector exterior portion and the base exterior portion to complete a circuit.

Example 20 is a system for an apparel compute device, the system comprising: means for providing a connector comprising: a magnetic layer; a conductor extending though the magnetic layer, the conductor including: a connector interior portion, the connector interior portion including an interface to a computer contained in a housing secured to the magnetic layer; and a connector exterior portion, the connector exterior portion of the conductor including a conductive structure extending perpendicular to the magnetic layer, the conductive structure arranged to orient the magnetic layer when connected to a base; means for providing a base comprising: a connector seat arranged to accept a connector for an apparel compute device; and a base connector extending through the connector seat, the base connector including: a base interior portion, the base interior portion including an interface to conductive lines incorporated into a garment; and a base exterior portion, the base exterior portion of the conductor including a conductive structure extending perpendicular to the connector seat; means for bonding the base to a first surface of a garment; means for connecting conductive lines of the garment to the base interior portion; means for seating the connector into the base via the magnetic layer, the connector exterior portion, and the base exterior portion; and means for connecting the conductive lines to the computer via the connector conductor and the base connector.

In Example 21, the subject matter of Example 20 optionally includes means for providing a housing bonded to the garment perpendicular to the connector seat and on a different surface of a fabric to which the connector seat is bonded; and means for providing a magnet held by the housing.

In Example 22, the subject matter of Example 21 optionally includes wherein the housing includes a removable cap, the removable cap, when removed, permitting removal of the magnet.

In Example 23, the subject matter of any one or more of Examples 20-22 optionally include wherein the means for seating the connector includes means for inserting the connector exterior portion into the base exterior portion to complete a circuit.

In Example 24, the subject matter of any one or more of Examples 20-23 optionally include wherein the means for seating the connector includes means for inserting the base exterior portion into the connector exterior portion to complete a circuit.

In Example 25, the subject matter of any one or more of Examples 20-24 optionally include wherein the connector exterior portion and the base exterior portion respectively extend outwards from the magnetic layer and from the connector seat, and wherein from seating the connector includes meshing the connector exterior portion and the base exterior portion to complete a circuit.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A connector for an apparel compute device, the connector comprising:

a magnetic layer;

a conductor extending though the magnetic layer, the conductor including:

an interior portion, the interior portion including an interface to a computer contained in a housing secured to the magnetic layer; and an exterior portion, the exterior portion of the conductor including a conductive structure extending perpendicular to the magnetic layer, the conductive structure arranged to orient the magnetic layer when connected to a base, the conductive structure having at least one of a width or length greater than a height, the height being the perpendicular distance between the magnetic layer and the termination of the conductive structure.

2. The connector of claim 1, wherein the exterior portion includes one or more additional conductive structures.

3. The connector of claim 1, wherein magnetic layer includes an exterior edge that is arranged to position the magnetic layer in alignment with a portion of the base when seated in the base.

4. The connector of claim 1, wherein the exterior portion extends outwards from an exterior surface of the magnetic layer.

5. The connector of claim 1, wherein the exterior portion extends inwards from an exterior surface of the magnetic layer.

6. Abase for an apparel compute device, the base comprising:

a connector seat arranged to accept a conductor for the apparel compute device, the connector seat bonded to a garment;

a connector extending through the connector seat, the connector including:

an interior portion, the interior portion including an interface to conductive lines incorporated into the garment; and an exterior portion, the exterior portion of the conductor including a conductive structure extending perpendicular to the connector seat;

a housing bonded to the garment perpendicular to the connector seat and on a different surface of a fabric to which the connector seat is bonded; and a magnet held by the housing.

7. The base of claim 6, wherein the exterior portion extends outwards from an exterior surface of the connector seat.

8. The base of claim 6, wherein the exterior portion inwards from an exterior surface of the connector seat.

9. The base of claim 6, wherein the connector seat is not magnetic.

10. The base of claim 6, wherein the housing includes a removable cap, the removable cap, when removed, permitting removal of the magnet.

11. A method for an apparel compute device, the method comprising:

providing a connector comprising:

a magnetic layer;

a conductor extending though the magnetic layer, the conductor including:

a connector interior portion, the connector interior portion including an interface to a computer contained in a housing secured to the magnetic layer; and a connector exterior portion, the connector exterior portion of the conductor including a conductive structure extending perpendicular to the magnetic layer, the conductive structure arranged to orient the magnetic layer when connected to a base;

providing a base comprising:

a connector seat arranged to accept a connector for an apparel compute device; and a base connector extending through the connector seat, the base connector including:

a base interior portion, the base interior portion including an interface to conductive lines incorporated into a garment; and a base exterior portion, the base exterior portion of the conductor including a conductive structure extending perpendicular to the connector seat;

bonding the base to a first surface of a garment;

connecting conductive lines of the garment to the base interior portion;

providing a housing bonded to the garment perpendicular to the connector seat and on a different surface of a fabric to which the connector seat is bonded;

providing a magnet held by the housing;

seating the connector into the base via the magnetic layer, the connector exterior portion, and the base exterior portion; and connecting the conductive lines to the computer via the connector conductor and the base connector.

12. The method of claim 11, wherein the housing includes a removable cap, the removable cap, when removed, permitting removal of the magnet.

13. The method of claim 11, wherein seating the connector includes inserting the connector exterior portion into the base exterior portion to complete a circuit.

14. The method of claim 11, wherein seating the connector includes inserting the base exterior portion into the connector exterior portion to complete a circuit.

15. The method of claim 11, wherein the connector exterior portion and the base exterior portion respectively extend outwards from the magnetic layer and from the connector seat, and wherein seating the connector includes meshing the connector exterior portion and the base exterior portion to complete a circuit.

* * * * *